US005787870A

United States Patent [19]

Summers et al.

[11] Patent Number: 5,787,870

[45] Date of Patent: *Aug. 4, 1998

[54] BOWSTRING NOCK WITH PEEP SIGHT ALIGNMENT TAB

[75] Inventors: Gregory E. Summers, 105 Overlink Ct., Lynchburg, Va. 24503; William G. Mayes, Monroe, Va.

[73] Assignee: Gregory E. Summers, Lynchburg, Va.

[ * ] Notice: The term of this patent shall not extend beyond the expiration date of Pat. No. 5,715,805.

[21] Appl. No.: 705,546

[22] Filed: Aug. 29, 1996

[51] Int. Cl.[6] ..... F41B 5/14

[52] U.S. Cl. ..... 124/91

[58] Field of Search ..... 33/265; 124/87, 124/90, 91

[56] References Cited

U.S. PATENT DOCUMENTS

| | | | |
|---|---|---|---|
| 2,488,597 | 11/1949 | Konold | 124/35.2 |
| 2,777,437 | 1/1957 | Allen | 124/91 |
| 4,086,904 | 5/1978 | Suski et al. | 124/90 |
| 4,134,369 | 1/1979 | Cook | 124/35.2 |
| 4,151,825 | 5/1979 | Cook | 124/35.2 |
| 4,656,994 | 4/1987 | Jenks | 124/23.1 |
| 4,909,233 | 3/1990 | Stephenson | 124/91 |
| 4,930,485 | 6/1990 | Kopper | 124/91 |
| 4,981,128 | 1/1991 | Garvison | 124/35.2 |
| 5,016,603 | 5/1991 | Tentler | 124/91 |
| 5,170,771 | 12/1992 | Peck | 124/35.2 |
| 5,361,747 | 11/1994 | Laabs | 124/91 |
| 5,390,657 | 2/1995 | Larson | 124/91 |
| 5,499,620 | 3/1996 | Summers | 124/91 |
| 5,537,986 | 7/1996 | Summers | 124/91 |

*Primary Examiner*—John A. Ricci
*Attorney, Agent, or Firm*—Nixon & Vanderhye P.C.

[57] ABSTRACT

A bowstring nock has a first half section provided with a first bowstring half groove extending in a first direction and a first fastener hole extending in a second direction, perpendicular to the first direction; a second half section provided with a second bowstring half groove extending in the first direction and cooperable with the first half groove to grip a bowstring therebetween, and a second fastener hole adapted for alignment with the first fastener hole to receive a fastener and thereby secure the first and second half sections together. One of the first and second half sections also includes a tab extending in the first direction a distance greater than a length dimension of the first and second half grooves, to assist in orienting a peep sight device mounted on the bowstring, above the nock.

10 Claims, 4 Drawing Sheets

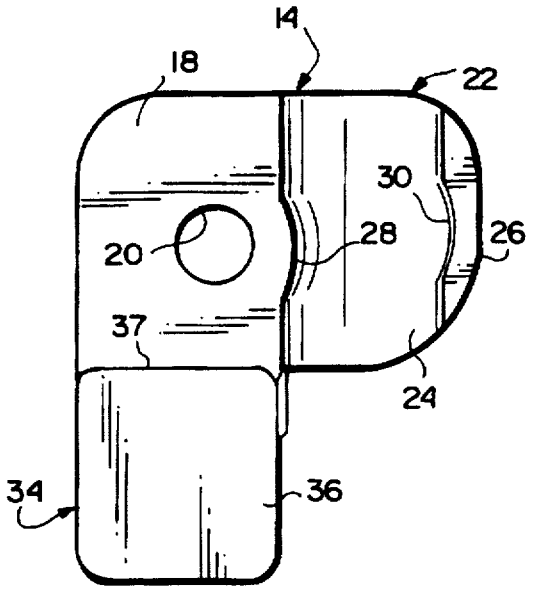
Fig. 3
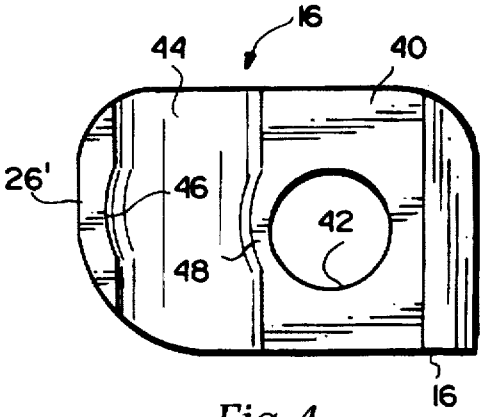
Fig. 4
Fig. 5
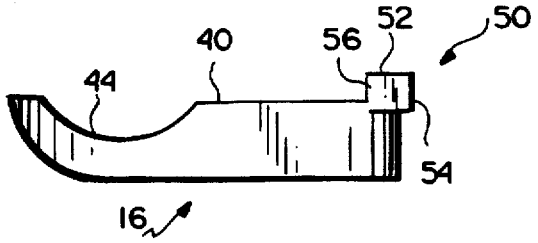
Fig. 6
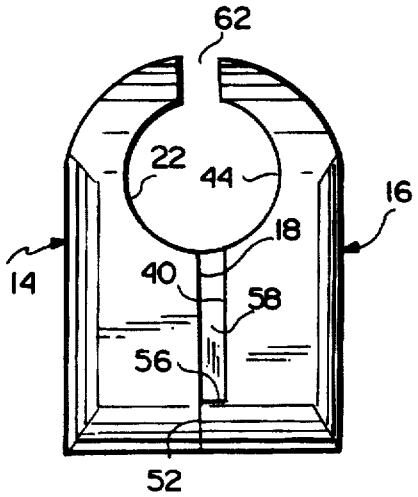

BOWSTRING NOCK WITH PEEP SIGHT ALIGNMENT TAB

This invention relates to a two-piece bowstring nock which serves not only to position the tail end of an arrow on a bowstring, but also serves to aid in the vertical alignment of a peep sight device also secured to the bowstring, above the bowstring nock.

BACKGROUND AND SUMMARY OF THE INVENTION

In the field of archery, it is conventional for an arrow to be provided with a string engaging fork, also known as an arrow nock, at the rear end of the arrow. It is also known to provide a bowstring nock which locates the arrow nock on the bowstring to facilitate good aim of the arrow. Accordingly, the bowstring nock must be located on the bowstring substantially at the center of the string, i.e., midway between the bowstring ends but slightly offset to accommodate the arrow which is on center, and substantially horizontally aligned with the point at which the forward end of the arrow is supported at the center of the bow. The bowstring nock may be located above or below the arrow nock. Representative bowstring nocks are described, for example, in U.S. Pat. Nos. 5,361,747; 4,909,233; and 2,905,156.

It is also known to provide various forms of hand held gripping and firing devices designed to cooperate with the bowstring nock or the bowstring itself, that enable an archer to apply a strong pull to the bowstring and release the arrow without having to grip the end of the arrow and the bowstring with the fingers. See, for example, U.S. Pat. Nos. 5,016,603 and 4,930,485.

One difficulty with conventional brass arrow nocks which are located above the arrow on the bowstring, and used in combination with a release device that engages the bowstring below the arrow, is the upward force exerted on the bowstring nock as the string is pulled to a fully drawn position. Oftentimes, the upward forces on the nock cause the latter to move upwardly along the bowstring thus causing a general misalignment of the arrow.

It is also conventional practice to mount a peep sight on the bowstring, and to keep the sight in proper rotational alignment with the aid of a small diameter rubber tube which is typically attached between the bowstring and, in the case of a compound bow, a pulley cable. The tube thus tends to keep the bowstring from rotating and thus misaligning the sight. While this arrangement is satisfactory from the standpoint of aligning the peep sight, it has been shown to slow the speed of the bowstring by as much as 6 to 15 feet per second.

SUMMARY OF THE INVENTION

It is the principal objective of this invention to provide a new bowstring nock which embodies several advantageous features relating not only to the conventional nock function vis-a-vis the arrow, but which also aids in the alignment of the peep sight device, thus eliminating the need for the previously used rubber tube.

In the exemplary embodiment of the invention, a two-piece bowstring nock is provided which, when assembled on the bowstring, has a downwardly (i.e., vertically as a frame of reference when the bow is in position for firing) extending tab which allows the archer to visually align the peep sight device with the bowstring nock. This alignment assures generally that when the bowstring is pulled rearwardly to a fully drawn position, the peep sight device will be in the correct rotational alignment. In the event of some slight rotation of the bowstring upon draw, the archer can compensate by loosening and rotating the nock slightly in the appropriate direction, recognizing that upon full draw, the peep sight will be correctly aligned. Thus, the bowstring nock of this invention not only serves to locate the arrow along the length of the bowstring, but also allows the user to visually align the peep sight device, while at the same time, this alignment tab assists in the proper location of the arrow nock in that the tab extends downwardly into the slot defined by the laterally spaced portions of the arrow nock.

It is another feature of this invention that the pair of half grooves located in the two bowstring nock sections, contain a machined detent which causes the nock, when assembled to the bowstring, to bite into the bowstring and therefore prevent unwanted upward or downward movement of the nock along the bowstring.

It is another feature of this invention that the forward end of the nock to have a generous radius at its forward edge which lies adjacent the arrow nock, referred to herein as a rocker radius. This provides a smooth transition at the arrow and bowstring nock interface, eliminating any unwanted biting of the bowstring nock into the arrow nock as the bowstring is pulled rearwardly to the fully drawn position.

It is also a feature of the present invention to form the bowstring nock sections, and to connect the two nock sections with a screw fastener, in such a way that the two nock sections apply spring tension to the screw as the latter is tightened, thereby precluding loosening of the screw during use.

Accordingly, in one aspect, the present invention relates to a bowstring nock comprising a first half section provided with a first bowstring half groove extending in a first direction and a first fastener hole extending in a second direction, perpendicular to the first direction; a second half section provided with a second bowstring half groove extending in the first direction and cooperable with the first half groove to grip a bowstring therebetween, and a second fastener hole adapted for alignment with the first fastener hole to receive a fastener and thereby secure the first and second half sections together; wherein one of the first and second half sections includes a tab extending in the first direction a distance greater than a length dimension of the first and second half grooves.

In another aspect, the invention relates to a bowstring nock comprising a pair of component parts including first and second aligned half grooves adapted to grip a bowstring therebetween; a depending tab extending in a direction parallel to the first and second half grooves and adapted to pass through an arrow nock slot; wherein the nock has a forward lower edge adjacent the half grooves with a radius of at least about 0.10".

In still another aspect, the invention relates to a bowstring nock comprising a pair of component parts including first and second aligned half grooves adapted to grip a bowstring therebetween; a depending tab extending in a direction parallel to the first and second half grooves and adapted to pass through an arrow nock slot; and wherein the half grooves are formed with detents along length dimensions thereof.

Other objects and advantages of the subject invention will become apparent from the detailed description which follows.

BRIEF DESCRIPTION OF THE DRAWINGS

FIG. 3 is a front elevation of the bowstring nock shown in FIG. 2, but mounted on a bowstring;

FIG. 4 is an exploded perspective view of the two parts which make up the bowstring nock in accordance with this invention;

FIG. 5 is a side elevation of one part of the nock;

FIG. 6 is a side elevation of the remaining part of the nock;

DETAILED DESCRIPTION OF THE DRAWINGS

Figure 1:
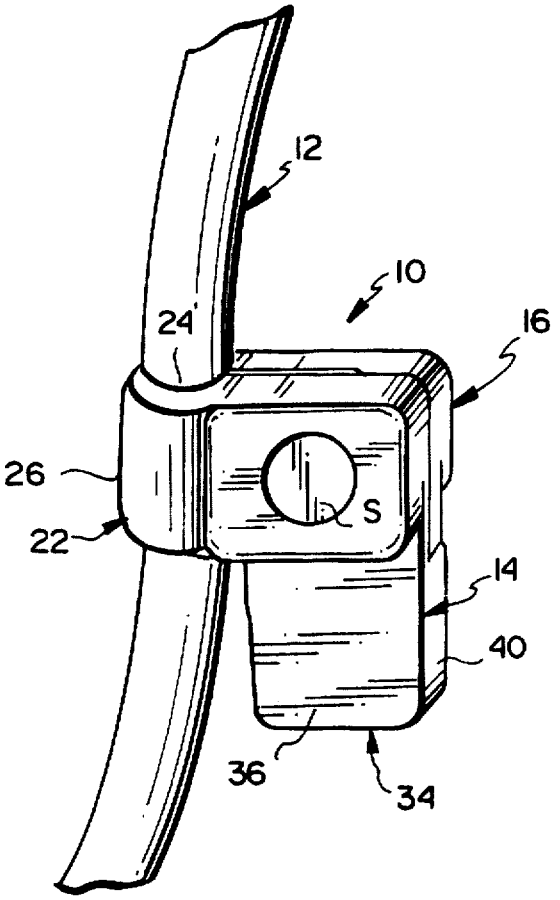
FIG. 1 is a partial perspective of a bowstring and bowstring nock in accordance with this invention.
Figure 2:
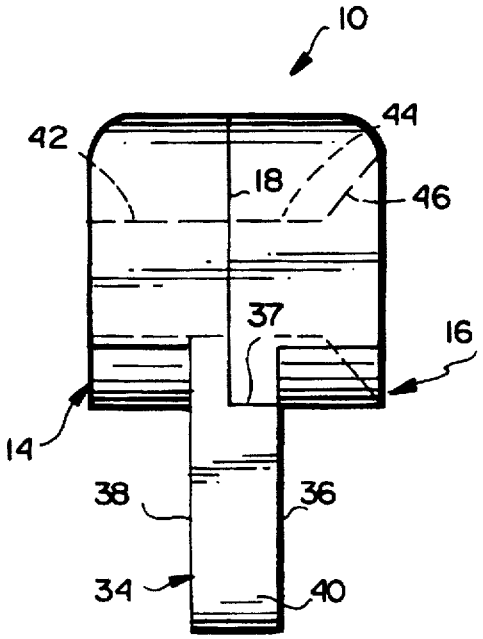
FIG. 2 is a rear elevation of the bowstring nock shown in FIG. 1.

Referring now to FIG. 1, a bowstring nock 10 in accordance with this invention is shown mounted on a bowstring 12. The bowstring nock 10 is generally comprised of two component parts or half sections 14 and 16 (preferably 7075 aircraft aluminum or other suitable material), secured by a fastener such as the screw S. Referring also to FIGS. 2 and 3, the bowstring nock component part 14 includes a flat assembly face 18, formed with a threaded fastener aperture 20. A bowstring engaging portion 22 extends away from the assembly face 18 and is formed with a half groove 24 located between a forward edge 26 of the nock and the fastener aperture 20. The half groove 24 is generally semi-cylindrical but is also provided with detents 28 and 30 which assist in clamping the bowstring and bowstring nock together as explained in further detail below.

A vertically oriented sight tab 34 also extends away from the face 18, but in a direction transverse to the direction of extension of the mounting portion 22. As best seen in FIG. 2, the sight tab 34 as opposed faces 36, 38 connected by an edge 40. This sight tab is laterally offset from the assembly face 18 (see FIGS. 2 and 8) so that when the two nock components 14 and 16 are assembled, the tab 34 is substantially vertically centered between the opposing sides of the nock. Thus, the sight tab 34 is also defined by an upper shoulder or edge 37 which is adapted to receive a lower edge of the component part 16 as described below.

As best seen in FIGS. 1 and 2, the tab 34 terminates at an unsupported free end, opposite that end which is defined by the upper shoulder or edge 37.

Turning now to FIGS. 4 and 5, the component part 16 also includes a flat face 40 formed with a smooth bore aperture 42 which is located so as to axially align with the aperture 20 when the component parts 14 and 16 are assembled as shown in FIGS. 1 and 2. The component part 16 is also formed with a half groove 44 adjacent the assembly face 40 on one side, and adjacent the forward edge 26' on the other side. The half groove 44 is similar to the half groove 22 and is adapted to be aligned therewith when the component parts are assembled so as to firmly grip the bowstring 12 therebetween. Note here that the half groove 44 is also formed with detents 46, 48 which are generally similar to the detents 28 and 30 described earlier. This feature is significant in that when the component parts 14 and 16 are assembled, the detent portions 28, 30, 46 and 48 bite into the bowstring so that the bowstring 12 is firmly gripped within the cooperating half grooves, and the possibility of any sliding movement along the bowstring is precluded.

Referring to FIGS. 5 and 6, near the rearward end of the component part 16, a squared, offset edge 50 is defined by surfaces 52 and 54 such that surface 52 abuts the flat mounting face 18 of component part 14 as best seen in FIG. 6. The lateral offset created by surface 56 establishes a gap 58 between the component parts 14 and 16, extending from the offset surface 56 to the pair of half grooves 22 and 44. The advantage to this construction will be explained in greater detail below.

Figure 7:
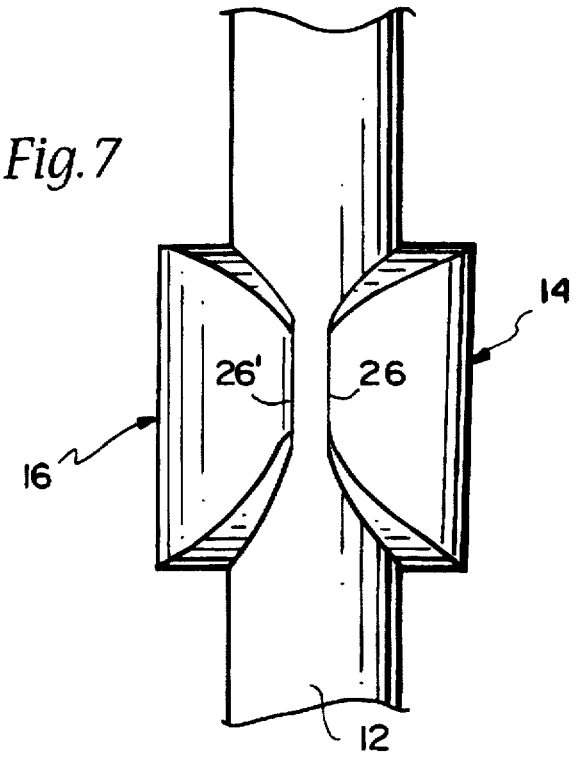
FIG. 7 is a front elevation of FIG. 6.
Figure 8:
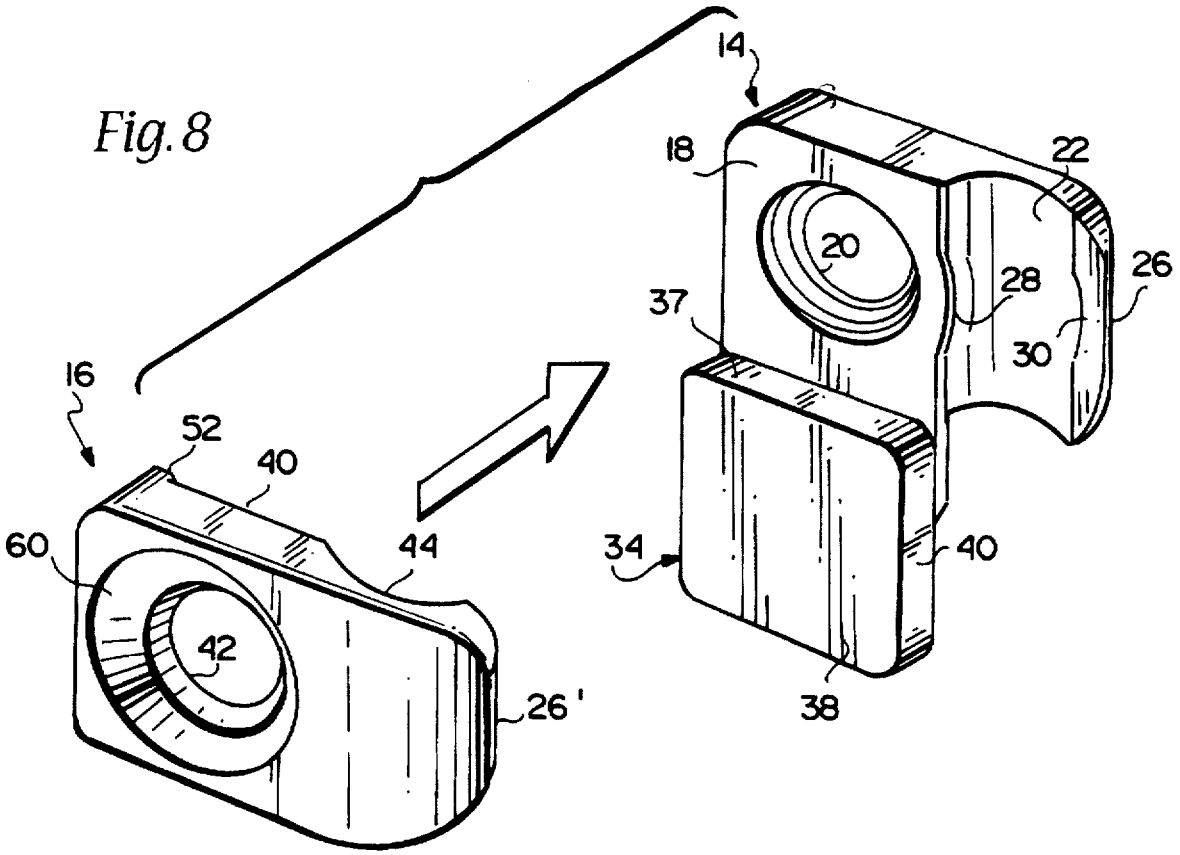
FIG. 8 is a plan view of the assembled nock.

With reference now to FIG. 8, it will be appreciated that the component part 16 is countersunk at 60 to receive the enlarged head of a fastening screw S by which the component parts 14 and 16 are secured together. It is important to note here that the half grooves 42 and 44 are not exactly semi-circular so that when the component parts are assembled, a gap 62 remains which is in substantially diametrically opposed relationship to the previously described gap 58. With this arrangement, when the screw is tightened to fasten the component parts 14 and 16 together, the half grooves 22 and 44 will be resiliently clamped onto the bowstring in the manner illustrated in FIGS. 1 and 7. As a result of this resilient or flexible clamping action, a resilient tension or bias is also placed on the screw fastener, precluding loosening of the screw during operation.

Figure 9:
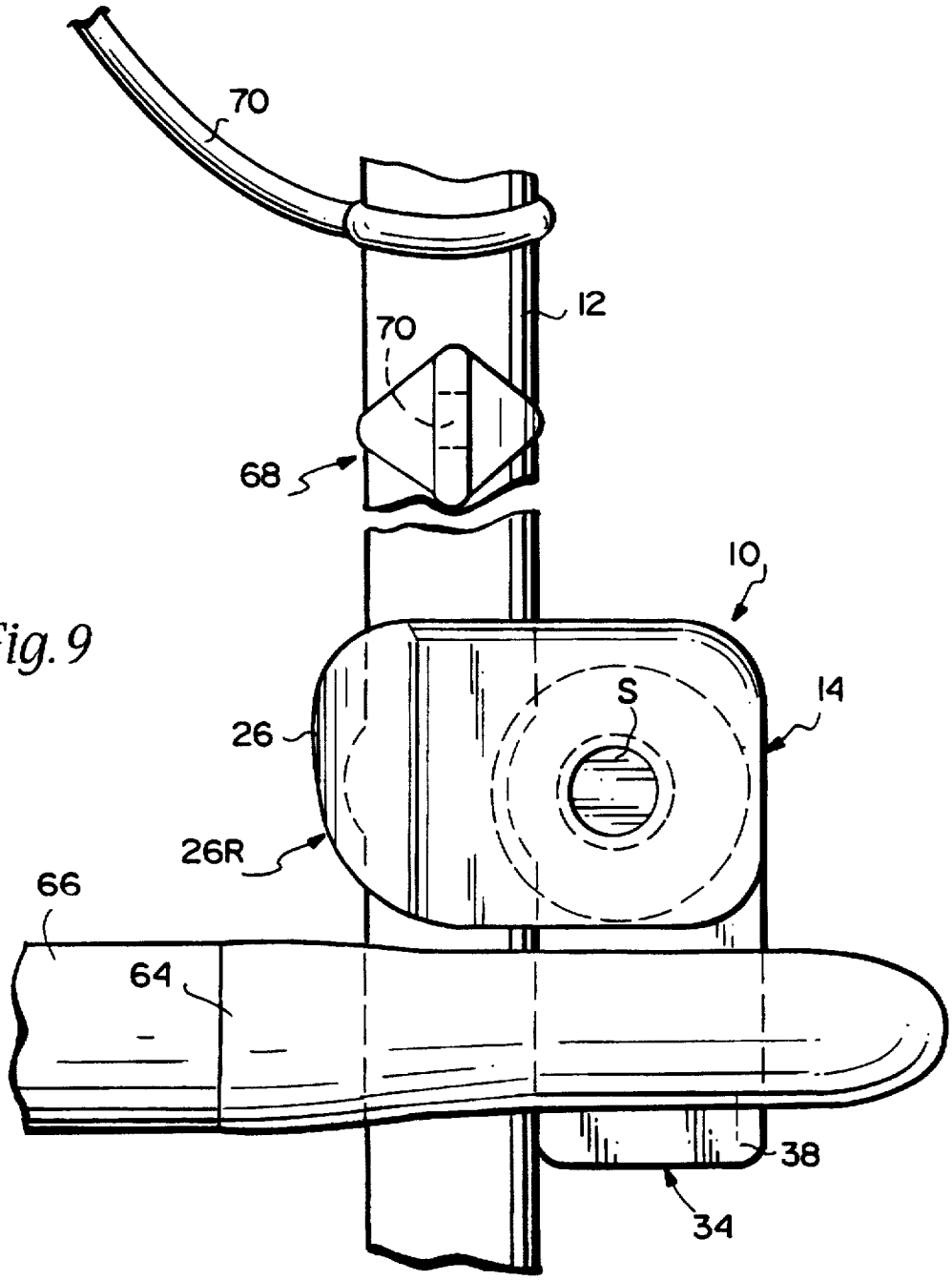
FIG. 9 is a partial side elevation showing the nock mounted on a bowstring, showing a peep sight device and an arrow in place prior to firing.

As best seen in FIGS. 3 and 9, the forward edge of the bowstring nock indicated by reference numerals 26 and 26', is formed with a larger radius adjacent that edge which is closest to the arrow nock. More specifically, the lower portion 26R of the forward edge 26 is radiused so as to eliminate any possibility of biting action between the bowstring nock 10 and the arrow nock 64, as otherwise might occur if the bowstring nock were formed with a sharply delineated forward edge. In a preferred embodiment, the radius is at least about 0.10 inch.

FIG. 9 also illustrates the overall relationship between the bowstring nock 10, the arrow nock 64 at the rearward end of the arrow 66 and the bowstring 12. The latter has attached thereto a peep sight device 68 having a sight aperture 70. FIG. 9 also illustrates a conventional rubber tube 70 attached to the bowstring 12 and which, as previously mentioned, has been used to keep the bowstring 12 from rotating during a draw and thus maintain the proper alignment of the peep sight device 68. In accordance with this invention, the archer aligns the peep sight device 68 with the tab 34 when the bowstring nock 10 is secured to the bowstring 12. With the bowstring nock 10 so mounted, the peep sight device 68 will generally be maintained in proper alignment as the bowstring 12 is pulled to a fully drawn position. However, since there is some amount of play between the slot in the arrow nock and the tab 34 of the bowstring nock 10, there may be some slight rotation of the bowstring 12 as the string is drawn rearwardly. If this phenomenon is experienced, the archer can then adjust the bowstring nock 10 by loosening the screw S and rotating the nock in the appropriate direction by an amount approximately equal to the amount of rotation of the bowstring 12 experienced by the archer. This, then, compensates for such rotation so that when the bowstring 12 is drawn rearwardly to the fully drawn position, the peep sight 68 will be in the proper rotational position, allowing the archer to fully sight the target.

Thus, the bowstring nock 10 in accordance with this invention performs no fewer than three functions: It serves the traditional function of a bowstring nock in that it locates the arrow nock 64 of the arrow 66 at the proper location along the bowstring 12. At the same time, the tab 34 facilitates alignment of the peep sight device 68, and the tab 34 also serves to align and hold the arrow nock 64 in its proper orientation.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring nock comprising:

a first half section provided with a first bowstring half groove extending in a first direction and a first fastener hole extending in a second direction, perpendicular to the first direction;

a second half section provided with a second bowstring half groove extending in said first direction and cooperable with said first half groove to grip a bowstring therebetween, and a second fastener hole adapted for alignment with said first fastener hole to receive a fastener and thereby secure said first and second half sections together;

wherein one of said first and second half sections includes a tab extending in said first direction a distance greater than a length dimension of said first and second half grooves and terminating at an unsupported free end.

2. The bowstring nock of claim 1 wherein said tab is centered relative to said bowstring nock.

3. The bowstring nock of claim 1 wherein said half grooves are each formed with an offset along said length dimension.

4. The bowstring nock of claim 1 wherein said first and second half sections are made of aluminum.

5. The bowstring nock of claim 1 wherein one of said first and second fastener holes is threaded and the other of said first and second fastener holes is countersunk to receive an enlarged head of the fastener.

6. A bowstring nock comprising:

a first half section provided with a first bowstring half groove extending in a first direction and a first fastener hole extending in a second direction, perpendicular to the first direction;

a second half section provided with a second bowstring half groove extending in said first direction and cooperable with said first half groove to grip a bowstring therebetween, and a second fastener hole adapted for alignment with said first fastener hole to receive a fastener and thereby secure said first and second half sections together;

wherein one of said first and second half sections includes a tab extending in said first direction a distance greater than a length dimension of said first and second half grooves; and wherein a lower and forwardmost edge of the bowstring nock adjacent said half grooves is formed with a radius of at least 0.010".

7. A bowstring nock comprising:

a first half section provided with a first bowstring half groove extending in a first direction and a first fastener hole extending in a second direction, perpendicular to the first direction;

a second half section provided with a second bowstring half groove extending in said first direction and cooperable with said first half groove to grip a bowstring therebetween, and a second fastener hole adapted for alignment with said first fastener hole to receive a fastener and thereby secure said first and second half sections together;

wherein one of said first and second half sections includes a tab extending in said first direction a distance greater than a length dimension of said first and second half grooves; and wherein said first and second half sections are formed with opposed flat faces in which said first and second fastener holes are respectively formed, one of said flat faces formed with an offset along a rearward edge thereof remote from and extending parallel to its respective half groove, such that, when said first and second half sections are assembled, they are engaged along said offset, leaving a gap between said first and second half sections adjacent said offset and along forward edges of said first and second half sections adjacent said half grooves.

8. The bowstring nock of claim 7 wherein, when said fastener is tightened, said half grooves are adapted to clamp a bowstring received in said half grooves, and a resilient bias is applied to the fastener as a result of said gap.

9. A bow string nock comprising a pair of component parts including first and second aligned half grooves adapted to grip a bowstring therebetween; a depending tab extending in a direction parallel to said first and second half grooves and adapted to pass through an arrow nock slot; wherein said nock has a forward lower edge adjacent said half grooves with a radius of at least about 0.10".

10. A bowstring nock comprising a pair of component parts including first and second aligned half grooves adapted to grip a bowstring therebetween; a depending tab extending in a direction parallel to said first and second half grooves and terminating at an unsupported free end, said tab adapted to pass through an arrow nock slot; and wherein said half grooves are formed with detents along length dimensions thereof.

* * * * *